United States Patent [19]

Pfaff et al.

[11] 4,308,848

[45] Jan. 5, 1982

[54] IGNITION SYSTEM FOR AN INTERNAL COMBUSTION ENGINE

[75] Inventors: Georg Pfaff, Asperg; Helmut Schmied, Remshalden, both of Fed. Rep. of Germany

[73] Assignee: Robert Bosch GmbH, Stuttgart, Fed. Rep. of Germany

[21] Appl. No.: 140,680

[22] Filed: Apr. 16, 1980

[30] Foreign Application Priority Data

Apr. 20, 1979 [DE] Fed. Rep. of Germany ..... 2915938

[51] Int. Cl.[3] ..... F02P 1/08

[52] U.S. Cl. ..... 123/618; 123/644; 123/651; 315/209 T

[58] Field of Search ..... 123/644, 618, 609, 651; 315/209 T

[56] References Cited

U.S. PATENT DOCUMENTS

| | | | |
|---|---|---|---|
| 3,605,713 | 9/1971 | Le Masters et al. | 123/625 |
| 4,176,645 | 12/1979 | Jundt et al. | 123/609 |
| 4,202,304 | 5/1980 | Jundt et al. | 123/618 |
| 4,217,874 | 8/1980 | Sohner et al. | 123/618 |
| 4,253,442 | 3/1981 | Jundt et al. | 123/618 |
| 4,271,812 | 6/1981 | Bodig et al. | 123/618 |

FOREIGN PATENT DOCUMENTS 2847290 5/1980 Fed. Rep. of Germany ..... 123/618

*Primary Examiner*—P. S. Lall

*Attorney, Agent, or Firm*—Frishauf, Holtz, Goodman & Woodward

[57] ABSTRACT

To improve an ignition system as described in U.S. Pat. No. 4,176,645, Jundt et al., in which a threshold switch is provided which controls current flow through the ignition coil, the turn-ON point of the current flow being determined, in part, by an integrator, and to prevent malfunction due to corroded terminals, improper installation and the like, a variable resistance branch, including a transistor 66, is connected across the integrator 31, 44, and so connected that, as the supply voltage drops, the effect of the integrator 31, 44 on the threshold switch 15, 16 is decreased, thus preventing modification of the inherent threshold level of the threshold switch by the action of the integrator. The transistor 66 in the variable resistance circuit 64 may be connected as a comparator, having its base connected to a junction J at fixed voltage (Zener diode 68, resistor 69), which is compared with the emitter-collector voltage, connected across the integrator 31, 44, and simultaneously changing its resistance value as the comparison is effected.

5 Claims, 2 Drawing Figures

IGNITION SYSTEM FOR AN INTERNAL COMBUSTION ENGINE

Figure 1:
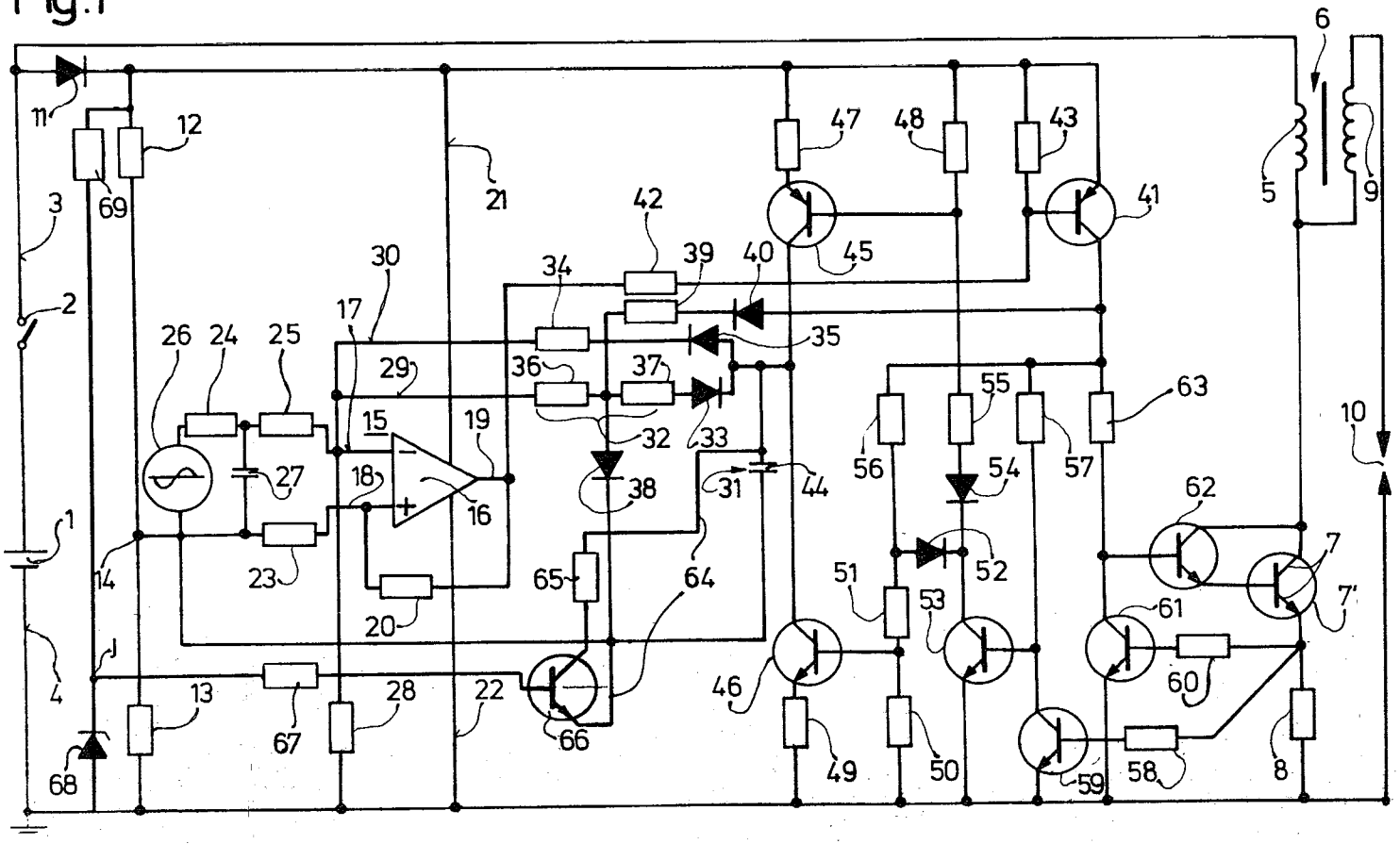

The present invention relates to an ignition system for an internal combustion engine, and more particularly to an ignition system which, in general, is described in U.S. Pat. No. 4,176,645, Jundt et al, assigned to the assignee of the present application.

Background and Prior Art.

The aforementioned U.S. Pat. No. 4,176,645, Jundt et al, the disclosure of which is hereby incorporated by references, relates to an ignition system for an externally ignited internal combustion engine, for example of the automotive type, in which a control signal generator is connected to a threshold switch, which responds to control signals therefrom. An electronic interrupter switch is arranged to conduct current during the switched-on condition of the threshold switch to control the ON-connection of current flow through the ignition coil. A signal is derived representative of this current flow, in form of a regulating voltage, that is, dependent upon the value of current flowing through the primary winding of the ignition coil, to control the switching ON instant and thus provide for controlled current flow through the ignition coil. An electrical circuit is used which includes an integrator, typically a capacitor, so connected that its direction of output voltage change is determined by the amount of current flowing through the interrupter switch—that is, also through the ignition coil—and, if the current flow exceeds a predetermined time limit, for example due to low speed of the engine—a regulating voltage is provided which generates a shift of the switch-ON voltage of the threshold switch in the direction towards the peak value of the control signal, to thereby control the ON-timing of a subsequent cycle of current flow through the ignition coil to be appropriate for the particular speed of the engine, and not in excess of the duration of current flow which is required.

It has been found that, due to an unfortunate concatenation of circumstances and defects, it is possible that the ignition event is not triggered. Upon starting, the on-board vehicular voltage is low. The peak value of the conrol signal then also will be relatively low. If, then, there is an unforeseen increase in the resistance of the circuit which includes the primary winding of the ignition coil, failure of ignition may result. Such increased resistance may occur, for example, due to excessive temperature, corroded or improperly installed terminals, replaced wiring lines with wires of excessive length and improper diameter, or the like. A current flowing through the primary winding then may not reach the value necessary to trigger a control signal, so that the threshold switch which gates the transistor to turn the ignition current ON will not be properly enabled. The ignition threshold value of the threshold switch thus will have a level in which the threshold will not be reached due to the relatively low peak value of current flow, thus interfering with starting of the engine.

The Invention.

It is an object to insure reliable ignition even if the originally installed ignition system has been tampered with or has been improperly maintained.

Briefly, the ignition system described in the aforementioned patent is modified by providing a resistance branch which bridges the integrator circuit thereof, the resistance branch having a controllable resistance, which is so connected to the overall circuit that its resistance decreases with decrease in the supply voltage for the entire system.

The arrangement has the advantage that even improper installation or maintenance and other unforeseen interferences with the ignition system will not cause failure of spark generation even under extremely low voltage conditions of the on-board vehicular network.

DRAWINGS

Figure 2:
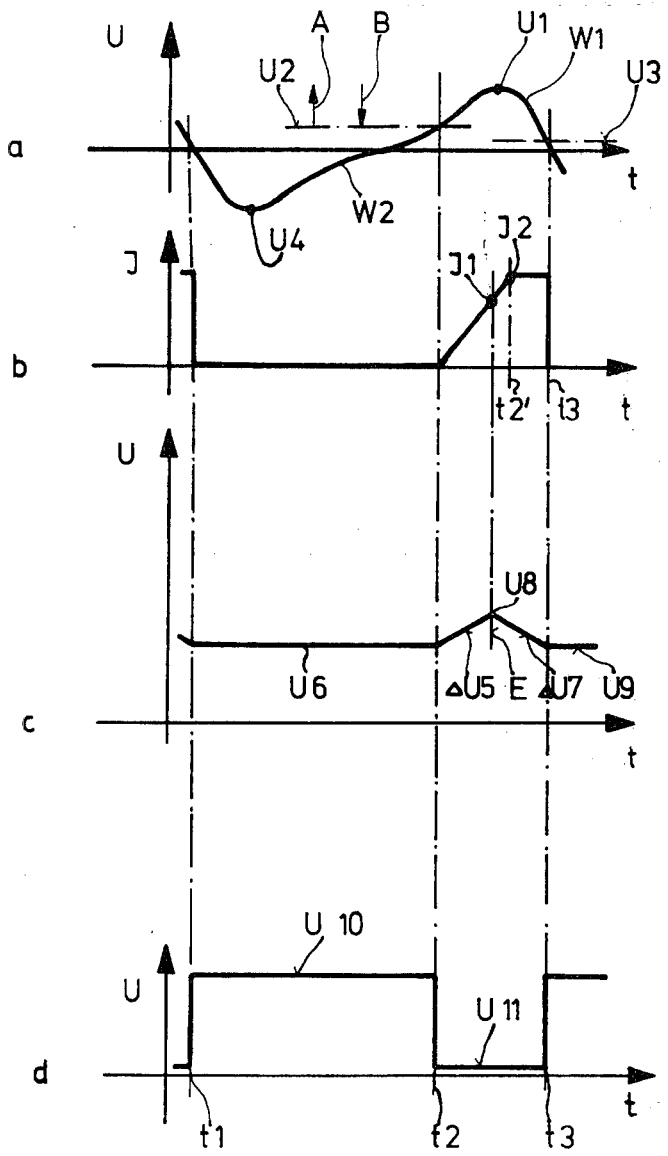

FIG. 1 is a circuit diagram of the ignition system which incorporates the additional feature of the present invention; and FIG. 2 is a series of three graphs used in connection with explanation of the operation of the present invention.

FIG. 1 is essentially identical to FIG. 1 of the aforementioned U.S. Pat. No. 4,176,645, and similar elements have been given similar reference numerals. The specific circuit which forms the present invention is circuit 64, comprising a resistor 65, a transistor 66, and a base resistor 67, connected to a junction J which has a fixed voltage level so that transistor 66 can be connected as a comparator with variable resistance determined by the emitter-collector voltage with respect to the reference voltage.

The circuit diagram of FIG. 1 represents the ignition system of an internal combustion engine (not shown), for example of the automotive type. The ignition system is fed from a direct current source 1 that can be the storage battery of the motor vehicle. The positive terminal of the battery is connected to the ignition switch 2 of the vehicle, through which it is connected to the positive voltage supply lead 3. The negative terminal of the battery is connected to the negative voltage lead of the ignition system 4 which is grounded to the vehicle chassis and engine structure as shown by the usual symbol at the lower left of the diagram. The positive voltage lead 3 is connected to a terminal of the primary winding 5 of a spark coil 6, through which primary winding it is connected then to an electronic interrupter switch 7, from which the circuit is completed over a monitoring resistor 8 to the negative voltage line 4.

The electronic interruptor switch 7 in the illustrated preferred embodiment is constituted by the emitter-collector path of a transistor 7'. The terminal of the primary winding 5 that is connected to the transistor 7' is connected to one end of the secondary winding 9 of the spark coil 6 and the other end of that secondary winding is connected to a spark plug 10 which completes the secondary circuit on the grounded side of its spark gap. Of course, the secondary winding 9 could be arranged to fire more than one spark plug by the provision of a spark distributor of the usual kind for distributing the ignition energy in a predetermined firing cycle to a number of spark plugs in the usual way.

The positive voltage supply line 3 provides positive voltage for the control portion of the ignition circuit through a diode 11 that is provided in the control circuit to protect the circuit against connection to the wrong polarity of supply voltage. When the ignition switch 2 is turned on, the battery supplies current through the diode 11, which is connected in its conducting direction, to a voltage divider composed of resistors 12 and 13 connected in series between the diode 11 and the negative voltage line. The connection between the resistors 12 and 13 is identified as the control circuit point 14 and this point has a potential of about half the voltage of the direct current source 1.

The ignition control circuit shown has a threshold switch 15 that in the illustrated preferred embodiment is constituted by an operational amplifier 16 that has an inverting input 17, a noninverting input 18 and an output 19 at which it provides a control voltage for following stages of the system. Positive feedback is provided by a resistor 20 connected between the output 19 and the noninverting input 18 so that the switch will change over quickly from one stable output voltage to another as the input voltage condition crosses a switching threshold. The operational amplifer 16 is supplied with power over lines 21, 22, respectively connected to the cathode of diode 11 and to the ground or chassis bus 4.

The non-inverting or direct input 18 of the operational amplifier 16 is connected through a proportioning or equalizing resistor 23 with the terminal or junction 14. A line 17 to the inverting input of the operational amplifier is connected over a series circuit of two proportioning resistors 24, 25 and then to a signal source 26 coupled to the engine, for which the ignition pulses are to be provided. The other terminal of the pulse source 26 is connected to junction 14. The common connection of the two resistors 24, 25 is connected to a capacitor 27 which, in turn, is connected across the pulse source 26 to protect the threshold switch 15 against noise pulses. The signal source 26, preferably, operates similarly to an a-c generator, and provides an a-c output voltage which has the approximate shape shown in FIG. 2, graph a.

The inverting input 17 is also connected over a resistor 28 to the negative voltage line 4 and, furthermore, over two parallel control lines 29 and 30 respectively operating for different control polarities determined by the diodes 33 and 35 respectively, to an integrator generically designated 31, in this case constituted simply by the capacitor 44. The integrator output voltage is a control voltage for shifting the switch-on threshold U2 (FIG. 2 line a) of the threshold switch 15. The first control lead 29 connects the inverting input 17 of the operational amplifier 16 to a series combination of a resistor combination 32 and a diode 33 that has its cathode connected to the integrator 31, while the second control lead 30 connects the inverting input 17 of the operational amplifier 16 through the series combination of a resistor 34 and a diode 35 that has its anode connected to the integrator 31. The resistor combination 32 is made up of two resistor components 36 and 37 with their intermediate connection connected to the anode of a diode 38, of which the cathode is connected back to the control circuit point 14. The common connection of the resistor components 36 and 37 is also connected through a resistor 39 and another diode 40 to the collector of the driver transistor 41. The diode is so poled that it conducts when the transistor 41 is fully conducting. The transistor 41 is a driver or feed transistor for the input circuit of the interruptor switch 7. Accordingly, the base of the transistor 41 is connected over a resistor 42 to the output connection 19 of the operational amplifier 16 and is also connected over a resistor 43 to its own emitter, which is connected to the positive voltage supply on the cathode side of the protective diode 11.

The integrator 31, as shown in FIG. 1, is in its simplest form merely a capacitor 44. The terminal of capacitor 44 remote from the control leads 29, 30 is connected to a circuit point or junction 14. The other terminal of the capacitor 44 is connected to the control leads 29, 30. Other circuits may be used to effect the integrating function by capacitor 44, for example by combining an operational amplifier with the capacitor to form the integrator 31.

The terminal of the integrator 31 which is not connected to the circuit point 14, in addition to being connected to the diodes 33 and 35 which feed its output control circuits, is connected to the collector of a first control transistor 45 and to the collector of a second control transistor 46, these transistors being of complementary types, in this case the control transistor 45 being a pnp transistor and transistor 46 being an npn transistor. The emitter of the first control transistor 45 is connected over a resistor 47 to the positive line coming from the cathode of the diode 11 and the base of this same transistor is likewise connected to that positive line over a resistor 48, so that a constant current flows through the emitter-collector path of this transistor 45, so that the circuit of this transistor operates as a constant current source. The second control transistor 46 has its emitter connected over a resistor 49 to the negative voltage supply line 4 and, likewise, its base connected to that same negative voltage supply line over a resistor 50, so that a constant current also flows through the emitter-collector path of this transistor 46 and its circuit also operates as a constant current source. The base of the second control transistor 46 is connected over a resistor 51 to the anode of a blocking diode 52, of which the cathode is connected both to the collector of an npn intermediate transistor 53 and to the cathode of another blocking diode 54, the anode of which is connected over a resistor 55 to the base of the first control transistor 45. The anode of the blocking diode 52 is also connected over a resistor 56 both to the collector of the driving transistor 41 and to one end of a resistor 57 of which the other end is connected to the base of the intermediate transistor 53.

From the ungrounded end of the monitoring resistor 8, a branch circuit leads over a resistor 58 to the base of an npn monitoring transistor 59 and is completed to the emitter of the transistor 59 which is grounded to the negative voltage lead 4. The collector of the monitoring transistor 59, which reproduces the feedback voltage to which the control circuit is responsive, is connected to the base of the intermediate transistor 53. There is still another branch circuit from the ungrounded end of the monitoring resistor 8, which leads over a resistor 60 to the base of a supplementary transistor 61 of npn type and is completed through the emitter of this transistor which is grounded to the negative voltage lead 4. The collector of the supplementary transistor 61 is connected to the base of an additional transistor 62 of npn type that has its emitter-collector path in shunt with the base-collector path of the transistor 7', so that it forms a Darlington circuit with the transistor 7'. The base of the transistor 62, which is the input of the Darlington circuit, is connected to the collector of the driver transistor 41, which as will be seen when the operation of the circuit is described, could also be called a coupling transistor. The timing signal from the timing wave generator which produces the voltage wave that switches over the threshold switch 15, at whatever level its thresholds may at the time be set, produces a wave that swings positive and negative with respect to the potential provided at the control circuit point 14, a wave which has at least one portion that rises to a positive peak value U1 (line a of FIG. 2) and then falls back again, the peak value U1 being reached only after a certain potential rise time and not by a sudden voltage step. Thus, there is provided in the illustrated case at least one positive halfwave W1 of the alternating voltage wave output of the timing signal generator 26, with reference to the potential of the control circuit point 14, which voltage halfwave operates as the timing signal proper. With the input shunt resistor 28 to the ground side of the circuit, the operation of the threshold switch 15 is so fixed that when the engine is started, the threshold switch 15 will be both switched on and switched off by the positive halfwave W1. Thus, as shown in line a of FIG. 2, under starting conditions of the engine, which may be referred to as the quiescent state condition for short, the switch-on threshold U2 and the switch-off threshold U3 of the threshold switch 15 lie barely above the zero crossover value of the output wave of the timing signal generator 26. The above-described relations have the advantage that if the ignition switch is closed while the engine is not running, the emitter-collector path of the transistor 7' is safely kept in the non-conducting condition, so that in such a case no current can flow through the primary winding 5. If such a current did flow, it would cause undesirable heating up of the spark coil 6.

The shift of the switching threshold U2 is so influenced by the circuit that during run-up of the engine into the operating speed range, the switching threshold U2 wanders towards the peak value U1 of the positive halfwave W1, which is to say it is shifted in the direction designated by the arrow A in FIG. 2 and, when the engine speed rises further in the operating speed range, it goes back in the opposite direction, designated by the arrow B in FIG. 2, away from the peak value U1. Thereafter, the switching threshold U2 can go so far from the peak value U1 of the positive halfwave W1 as to reach at least to the neighborhood of the peak value U4 of the negative halfwave W2 provided by the timing wave generator 26.

The switch-off threshold U3 is kept fixed in its position so long as the speed of the engine rises and the switch-on threshold U2 has not yet gone back to its initial position as it is moved away by the control voltage from the timing wave peak value U1. As soon as the switch-on threshold U2 gets back to its initial position, then any further increase of the engine speed shifts the switch-off threshold U3 along with the switch-on threshold U2 in the direction B and actually shifts the former in that direction somewhat ahead of the switch-on threshold U2.

The displacement of the switch-on threshold U2 is accomplished in the manner indicated by the voltage-time diagram drawn on line c of FIG. 2. As there shown, as soon as the threshold switch 15 switches on, at the moment t2, the integrator 31 begins to produce a threshold change ΔU5 to the initial integration output value U6 that existed during the interval t1–t2 preceding the operation of the threshold switch 15. The end of the first voltage change ΔU5 and the beginning of the immediately following second voltage change ΔU7, occurring at the peak integration value U8 is made dependent upon the rise of current flow in the primary winding 5 to a predetermined control value J1, that is indicated on line b of FIG. 2 where the primary current J is plotted against the time t. The end of the second control voltage change ΔU7 is determined by the switching off of the threshold switch 15. The integration output value U9 existing at that switch-off moment remains substantially conserved during the following interval until another change of the first kind begins. The first change ΔU5 and the second change ΔU7 are so set that when the engine speed remains the same, they are symmetrical with respect to a vertical line E on the timing diagram through the peak integrator output value U8, with the changeover from the first change ΔU5 to the second change ΔU7 is chosen to take place at the empirical control value of primary current J1. That current value is not the actually desired final primary coil current. The current in the primary winding 5 is allowed to rise further to a desired final value J2 at which sufficient energy is stored in the spark coil 6 to produce a fully effective ignition spark.

In the illustrated case the voltage changes ΔU5 and ΔU7 are produced by currents of the same strength. Of course, one of these currents could be made to be stronger than the other, in which case its period of flow would be made shorter than that of the other.

In the preferred embodiment, the first change ΔU5 is an increase of the integrator output voltage and the second change ΔU7 is a decrease of the integrator output voltage (i.e. of the charge across the capacitor 44).

It should be further mentioned that, as shown in the voltage-time diagram on line d of FIG. 2, the potential U10 at the output of the threshold switch 15 in the switched-off condition of the latter, which is to say the voltage there during the time period t1–t2, should be at or at least very close to the potential of the positive voltage supply line 3 and the potential U11 at the output 19 in the switched-on condition of the threshold switch, which is to say the potential there during the period t2–t3, should be at or at least very close to the potential of the negative voltage supply line 4, which is the supply line grounded to the chassis in the diagram.

In accordance with the present invention, a resistance branch 64 of variable resistance bridges the integrator 31, in FIG. 1 the capacitor 44. The resistance value of the resistance branch decreases with decreasing supply voltage. The resistance branch 64 is so arranged that the control voltage will not have any influence on the threshold switch 15 at lower supply voltage limits. The resistance value 64, in the preferred form, comprises the series circuit of a fixed resistor 65—which may be adjustable—and of the emitter-collector path of an npn transistor 66. The base of transistor 66 is connected over a base coupling resistor 67 to a junction J at which a reference potential is available. The reference potential is derived from the series connection of a Zener diode 68 and a resistor 69. The cathode of Zener diode 64 is connnected to ground, chassis or reference bus or line 4. Resistor 69 is connected to the cathode of diode 11.

Operation:

When the ignition switch 2 is closed and the engine is started and the timing signal from the signal generator 26 next rises above the switch-on threshold U2 of the threshold switch 15, the potential U11 appears at the output connection 19 of the threshold switch which, as already mentioned, is substantially at the potential of the negative voltage supply line 4. Control current then begins to flow through the base-emitter path of driver transistor 41 causing the emitter-collector path of this transistor to be conducting. In consequence, the base-emitter path of the input transistor 62 of the Darlington circuit receives current and also the base-emitter path of the switching transistor 7', so that its emitter-collector path likewise becomes conducting and current begins to flow through the primary winding 5.

As already explained, in the quiescent or starting condition the threshold U2 lies barely above the zero axis of the voltage wave produced by the timing signal generator, which is to say, barely above the potential of the circuit point 14, so that it is assured that even if the voltage wave of the timing signal generator has a relatively low peak value when the engine first starts up, the threshold switch 15 will nevertheless be switched on.

When the driver transistor 41 conducts, the base-emitter path of the intermediate transistor 53 will also receive current, so that its emitter-collector path will conduct and provide base-emitter current for the first control transistor 45, so that the emitter-collector path of the transistor 45 will also be conducting. In consequence, the integrator 31, which has up to now had the output voltage U6, now begins to make the voltage change ΔU5 at its output, until the flow of current in the primary winding 5 builds up to the control valve J1. When that happens, the voltage drop across the monitoring resistor 8 reaches a value at which the emitter-collector path of the monitoring transistor 59 is caused to become conducting. When that happens, the base-emitter path of the intermediate transistor 53 is shortcircuited and accordingly the corresponding emitter-collector path is blocked, and likewise the emitter-collector path of the first control transistor 45. Then current will be supplied from the emitter-collector path of driver transistor 41 to the base-emitter path of the second control transistor 46 and the now conducting emitter-collector path of the latter transistor will produce the second change ΔU7 of the control voltage, which begins with the integration output value U8 which was reached when the above-described events took place as a consequence of the current in the primary winding having reached the value J1.

The second change ΔU7 of the control voltage ends as soon as the voltage wave of the timing signal generator 26 drops down below the switch-off threshold U3 of the threshold switch 15. When that happens, the potential U10 appears at the output of the threshold switch 15, which potential, as already mentioned, lies close to the potential of the positive voltage supply line 3. Then no more control current can flow through the base-emitter path of the driver transistor 41, and the emitter-collector path of that transistor accordingly becomes non-conducting. The control current in the base-emitter path of the second control transistor 46 therefore also vanishes, the emitter-collector path of the latter transistor then becoming non-conducting and causing the end of the second change ΔU7 of the output of the integrator 31. When the driver transistor 41 switches over into the non-conducting condition, the emitter-collector path of the transistor 7' likewise becomes non-conducting, interrupting the flow of current in the primary winding 5 and producing a high voltage pulse in the secondary winding 9 that produces an ignition spark in the sparkplug 10.

The supplementary transistor 61 assures that the current in the primary winding 5, after having reached a desired value J2 which is sufficient for a fully effective ignition spark, will not increase any further. After the desired value J2 of primary winding current has been reached, the emitter-collector path of the supplementary transistor 61 is made somewhat conducting by the voltage drop across the monitoring resistor 8 and in consequence the conductivity of the emitter-collector path of the transistor 7' is somewhat reduced, just enough to keep the current flow at the desired value J2. It is desirable for the circuit to be so designed that during starting of the engine, the current in the primary winding 5, after reaching the desired value J2, will continue to flow at this same strength for a further time period t2'–t3, so that during the acceleration of the vehicle driven by the engine sufficient energy for ignition will still be stored in the primary winding 5 in spite of the shortening of the period of the flow of current.

During run-up of the engine after start-up, the second change ΔU7 of the integrator output lasts longer than the first change ΔU5, so that the integration value U9 after the second change ΔU7 is in each cycle more negative than the integration value U6 before the beginning of the first change ΔU5. This affects the inverting input 17 of the switch 15 over the first control lead 29, so that the switch-on threshold U2 of the threshold switch 15 wanders in the positive direction indicated by the arrow A in FIG. 2. If the engine speed rises still further, however, the second change ΔU7 of the output of the integrator 31 will last for a shorter period than the first change ΔU5, so that the integration result U9 after the second change ΔU7 will be more positive than the initial integration value U6 before the first change ΔU5. This operates over the first control lead 29 of the inverting input 17 of the switch 15 and—after the integration value U9 become positive relative to the control circuit point 14—so that the switching threshold U2 will now wander in the negative direction indicated by the arrow B in FIG. 2. The coupling of the integrator to the threshold switch through the lead 29 operates through a path of lower ohmic resistance than the coupling through the second control lead 30 to the inverting input 17 of the threshold switch.

When the engine is started, the primary winding 5 is at once provided with current for the time necessary to provide energy for a fully effective ignition spark and by the operation of the supplementary transistor 61, the switching transistor 7' is temporarily operated in its active region, which is to say that there is some dissipation in the circuit of the spark coil primary, but that happens in a speed range through which the engine passes only in starting up and the engine runs through that range relatively fast. The advantage is obtained, on the other hand, that during the operation of the engine in the speed range in which the switch-on threshold U2 of the threshold switch 15 moves away from the region of the peak value U1 of the positive halfwave W1 into the neighborhood of the opposite peak value U4 of the negative halfwave W2, a sufficiently constant amount of energy is stored in the start coil 6 in every cycle up to a relatively high engine speed without energy waste, in the ignition circuit over practically the whole range of normal engine running.

By the switching over of the emitter-collector path of the driver transistor 41 into the conducting condition, the circuit branch through the diode 40, the resistor 39 and the diode 38 to the control circuit point 14 is also effective, so that in the switched-on condition of the threshold switch 15 the common connection point of the resistor components 36 and 37 comes at least very close to the potential of the control circuit point 14 and the influence exerted by the integrator 31 on the threshold switch 15 is blocked. In this manner, it is provided in a very simple way that the switch-off threshold U3 of the threshold switch 15 will have a stabilized position, so long as the switch-on threshold U2 is shifted from its quiescent position towards the peak value U1 of the positive halfwave W1. The ignition timing instant is thus not subject to any disturbance from the effect of the integrator 31. At higher speeds this stabilization is no longer necessary, because the portion of the voltage timing wave following the peak value U1 then falls off relatively steeply.

Since in the ignition system of the present invention the regulation of the period of current flow in the primary winding 5 is dependent upon the rise of this current to a predetermined value, namely the control value J1, a constant amount of ignition energy storage per cycle is obtained even with variation in the voltage of the direct current source.

If the peak values of the control signals—for example upon starting—are relatively low, and the supply voltage also is relatively low and, when additionally, a relatively high resistance occurs in the branch circuit which includes the primary winding 5 of ignition coil 6, the ignition event—flashover of the spark at spark gap 10—may not occur. An unusually high resistance in the branch including the primary 5 of ignition coil 6 may occur due to excessively high temperature, corroded terminals, excessively long connecting lines, particularly if of improper wire diameter, and the like. The current flowing through the primary winding 5 then will not reach the control value J1, so that the first change ΔU5 at the voltage value U8 (FIG. 2) will not terminate, but rather continue up to the time period t3. A control voltage will thus be obtained which results in a large shift of the switching threshold on the threshold switch 15 which, however, does not reflect actual operating conditions. The control signal U1, as noted due to starting conditions for example, will have a low value and may not reach the switching threshold U2 of the threshold switch, so that ignition will fail. No ignition spark will be triggered.

The present invention avoids this difficulty. The resistance branch 64 decreases the influence of the control voltage supplied from the integrator 31 with decreasing supply voltage. This is achieved by increasing the conductivity, that is, decreasing the resistance, of the emitter-collector path of the transistor 66 in the variable resistance branch 64. The voltage applied to the base of the transistor 66 is held at a constant level by Zener diode 68. The voltage at the emitter of the transistor, changes and thus the conductivity of the transistor 66, overall, changes. The circuit is so arranged that, upon drop of supply voltage, the switch-on threshold level as affected by the integrator 31 is decreased due to the increased shunting or bypass conduction effect of transistor 66 upon decreased supply voltage, and hence decreased voltage across the emitter-collector path of the transistor 66.

Various changes and modifications may be made within the inventive concept. The resistance value of the resistance branch 64, for example, should be matched to the particular system and the system voltage. Preferably, the resistance value of the resistance branch 64 is so selected that, at a lower limit of supply voltage, the conduction of transistor 66 is such that all controlling effect of the integrator 31 on the threshold switch 15 is excluded.

In an operating example, arranged for a 12 V-nominal ignition system, in which the integrator 31 is represented by a capacitor 44, the lower limit at which the integrator 31 is to be effective is a supply voltage of about 6 V. Transistor 66 is a npn-silicon-transistor, the voltage at junction J is about 4 V, and the resistance of resistor 65 is 20 kilo ohms. The voltage across the integrating capacitor 44 will be representative of the supply voltage due to the conduction of control transistor 45.

We claim:

1. Ignition system for an externally fired internal combustion engine, having a current supply circuit (1, 3, 4, 11) adapted for connection to a source (1) of current supply;

an ignition coil (6) having a primary (5) and a secondary (9) winding;

a controlled semiconductor switch (7) controlling current flow through the primary winding (5) of the ignition coil (6);

a control circuit (8, 59, 53, 45; 15, 31–38) including a threshold switch (15) and an integrator (31, 44) responsive to ignition trigger signals and to current flow through the primary winding (5) of the ignition coil, in which the integrator (31) is connected to the threshold switch (15) to change its threshold response level as a function of integrated current flow through the primary winding of the ignition coil, and comprising, in accordance with the invention, a safety circuit to prevent change of the response level of the threshold switch under control of the integrator under certain low supply voltage conditions which is characterized by a variable resistance circuit (64) connected across the integrator and further connected to be responsive to the voltage level of the current supply circuit, the resistance of said variable resistance circuit decreasing with decreasing voltage across said current supply circuit.

2. Safety circuit according to claim 1, wherein the variable resistance circuit (64) comprises a controlled resistance element (66) connected as a comparator to a source of reference voltage (J) and to the voltage on the integrator to increase the conduction of said element if the voltage across the current supply circuit drops.

3. Safety circuit according to claim 1 or 2, wherein the resistance of the variable resistance circuit (64) is matched to the integrator (31) and to the threshold switch (15) to effectively remove the influence of the control voltage from the integrator (31) to the threshold switch (15) when the voltage across said current supply circuit has decreased below a predetermined value.

4. Safety circuit according to claim 1, wherein the variable resistance circuit (64) comprises a transistor (66) and a resistor (65), the emitter-collector path of the transistor (66) and the resistor (65) being connected in series and across the output of the integrator (31);

means (68, 69) providing a reference voltage at a reference terminal (J), the reference terminal being connected to the base of said transistor to compare the emitter-collector voltage across the integrator with the reference voltage and change the conductivity of the transistor (66) upon change of the voltage across the integrator (31) with respect to the voltage level of the reference terminal (J).

5. Safety circuit according to claim 4, wherein the conductivity of the transistor (66) and the resistance of the resistor (65) are matched to the operating parameters of the integrator (31) and the threshold circuit (15) to effectively remove control by the integrator (31) on the threshold circuit if the voltage across the current supply circuit drops below a predetermined level.

* * * * *